United States Patent [19]

Tesser

[11] Patent Number: 4,563,825

[45] Date of Patent: Jan. 14, 1986

[54] BOOT PARTICULARLY FOR SPORTSWEAR

[75] Inventor: Igino Tesser, Treviso, Italy

[73] Assignee: Nava & C. S.p.A., Como, Italy

[21] Appl. No.: 415,776

[22] Filed: Sep. 8, 1982

[30] Foreign Application Priority Data

Nov. 20, 1981 [IT] Italy ..... 25216 A/81

[51] Int. Cl.[4] ..... A43B 5/00

[52] U.S. Cl. ..... 36/131; 36/3 R

[58] Field of Search ..... 36/117, 118, 119, 120, 36/121, 3 R, 50, 131; 24/68 SK, 70 SK, 71 SK, 69 SK

[56] References Cited

U.S. PATENT DOCUMENTS 3,906,645 9/1975 Heckel ..... 36/131
4,062,133 12/1977 McGee et al. ..... 36/131
4,179,827 12/1979 Vaccari ..... 36/119
4,184,273 1/1980 Boyer et al. ..... 36/117 X
4,267,651 5/1981 Albano ..... 36/131

FOREIGN PATENT DOCUMENTS 2025283 12/1971 Fed. Rep. of Germany ..... 36/120

*Primary Examiner*—Werner H. Schroeder
*Assistant Examiner*—T. Graveline
*Attorney, Agent, or Firm*—Ladas & Parry

[57] ABSTRACT

A boot, particularly for sports use, consisting of a boot to which a legging is coupled by an articulation and houses an internal element. The boot includes a vamp which is provided with a legging which holds, at the height of the malleolus of the wearer's foot, articulated elements which hinge to the legging of the vamp pairs of perforated appendices in the lower part of two semi-leggings movably secured to each other by securing devices.

15 Claims, 15 Drawing Figures

BOOT PARTICULARLY FOR SPORTSWEAR

SUMMARY

The boot illustrated in FIG. 2 consists of an external boot A to which is secured a legging formed by two parts, a front part $B_1$ and rear part $B_2$, provided on their lower parts with overlapping appendices 30–38 hinged on their bottom parts to the sides of vamp 12 of said boot by means of pin 44. The two semi-leggings $B_1$ and $B_2$ are secured to each other by adjustable locking means $C_1$.

The boot is completed by an internal element D consisting, in turn, of a boot $D_1$ with relevant sock $D_2$. The top part of the latter is provided with a shaped collar 130 provided in turn with an annular chamber communicating with the exterior through apertures 140 and with an interspace formed between the exterior of sock $D_2$ and the inner wall of legging $B_1$, $B_2$ for ventilation of the wearer's foot. The annular interspace extends downward upto or close to inner boot $D_1$ and is provided with vertical channels formed by hollow strips 128 secured to sock $D_1$ of internal element D.

The latter is movably secured to outer boot A by disassemblable connecting means consisting of a perforated tab 112 for a key 116 cooperating with sole 10 of said boot.

DESCRIPTION OF THE INVENTION

This invention relates a boot, in particular a boot for sports use with particular, but not exclusively for boots for sportswear, for example, for motorcyclists, skiers etc., said boots must be apt to meet specific requirements of use, such as impermeablility, and above all, flexibility to facilitate deambulation.

The known types of boots for sportswear are fabricated in molded plastic materials which are duly waterproof, but are lacking in flexibility and do not afford adequate ventilation for the wearer's foot.

This invention proposes to provide a boot for sportswear which is satisfactory in all respects in the sense that it affords proper ventilation of the user's foot as well as flexibility to permit expeditions and easy deambulation.

A further object of the invention is to provide a sports boot which affords a safe protection for the wearer's feet, without hampering or limiting deambulation, and, above all, without making the boot excessively heavy whilst in emergency situations, the boot may be easily and quickly removed from the wearer's foot.

The boot according to the invention, consisting of a boot to which the legging is connected by a universal joint, and which houses an internal element, is characterized in that the vamp of the boot has a legging which holds at the height of the malleolus of the foot, articulated elements which hinge to said legging of the vamp. Pairs of perforated appendices in the bottom part of two semi-leggings are secured to each other by locking devices, while the internal element has, in its top part, an annular chamber communicating with the exterior through apertures and with the interior of the boot through an interspace delimited by the interior of the legging and the exterior of said inner element, thereby to ventilate the interior of the boot.

According to this invention the sock contemplated in the internal element of the boot terminates on its top part with a flexible collar having an annular chamber communicating with the ambient through apertures located mainly on the rear and with the annular interspace of the boot through channels formed by hollow vertical strips secured to said sock and which extend up to or close to the sole of the inner element of the boot.

The invention will now be explained in conjunction with the annexed drawings which illustrate, by way of example, one preferred form of embodiment of the boot.

Figure 1:
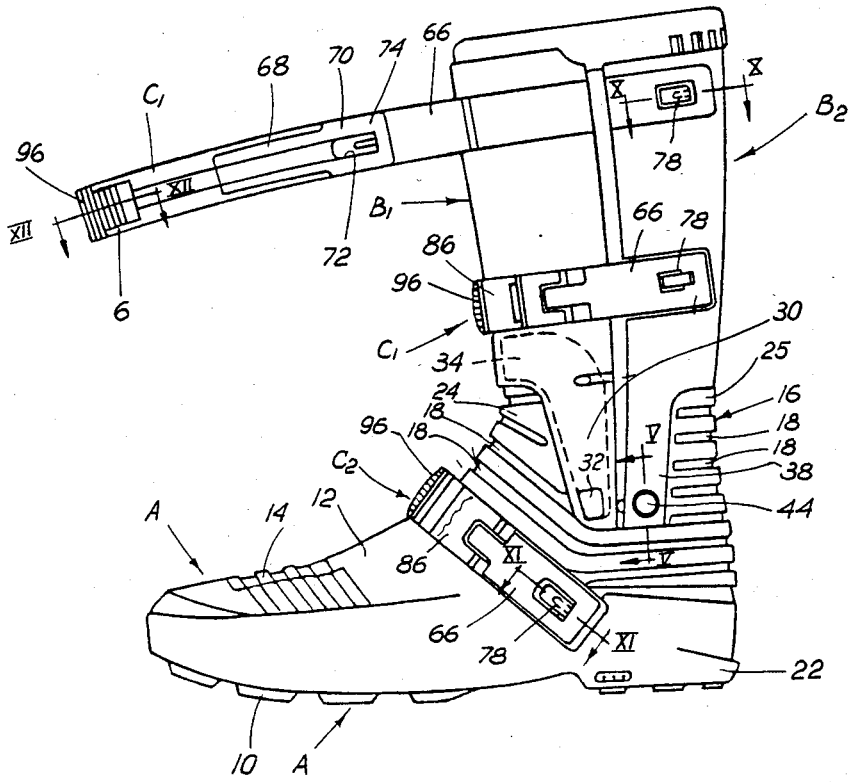
FIG. 1 is a side elevation view of the boot, with some parts removed.
Figure 13:
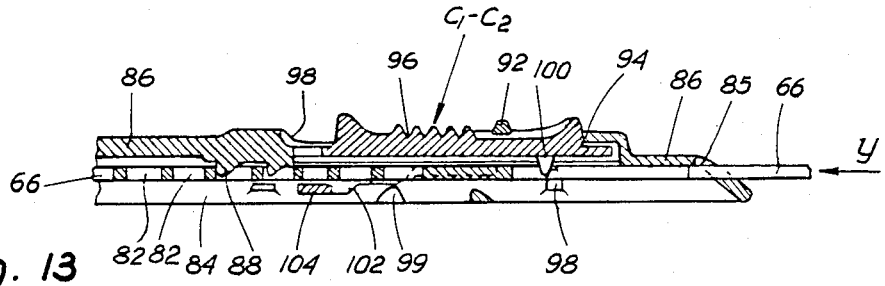
FIG. 13 is similar to FIG. 12 though taken in the opposite direction.
Figure 14:
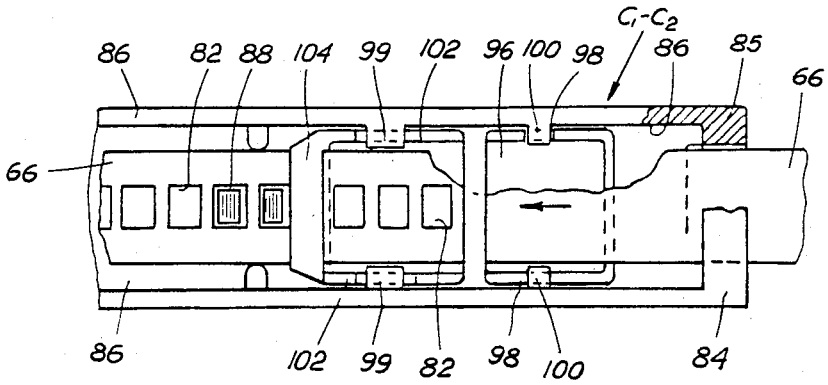
FIG. 14 is a view from bottom to top of FIG. 13.

The boot illustrated in the drawings contemplates a base structure or external boot A, a legging formed by two complementary parts: a front part $B_1$ and a rear part $B_2$ secured to each other by adjustable locking means $C_1$ and an internal element D secured to base structure A by a locking element $C_2$, identical to $C_1$. These parts are movably joined to each other to form when the shoe is worn a flexible articulated structure as will be described hereafter and which enables the user to deambulate freely and without difficulty. The boot illustrated is prevalently made of molded plastic materials and its different constituent parts are separable and joinable to each other without need to use special tools, which facilitates and expedites wearing of said boot.

The base structure or boot A, is made of resilient flexible material and sole 10 is integral with vamp 12 which is provided, toward its point with transversal grooves 14 to afford the necessary flexibility. Vamp 12 terminates, in its rear part with a legging 16 which extends upward over the malleolus and which is provided with front and rear peripheral grooves 18 to form a bellows like structure. The base structure or boot proper A, is provided with lateral holes 20 under the heel to discharge any water or condensate which may form or accumulate inside said boot, while the rear part terminates with a prong 22 which is used as a grip to remove the boot.

Vamp 12 forms, laterally, two opposite pairs of tabs 24–25 which involve and cover the wearer's malleolus, the elements of each pair being spaced with respect to each other, to form a V shaped slot substantially aligned with the lower extremities of the opposite vertical edges of semi-leggings $B_1$ and $B_2$. Said pair of tabs 24–25 are provided, adjacent to their vertexes, with means to hold movably locked to each other the two semi-leggings $B_1$ and $B_2$ by means of adjustable coupling devices $C_1$.

Figure 6:
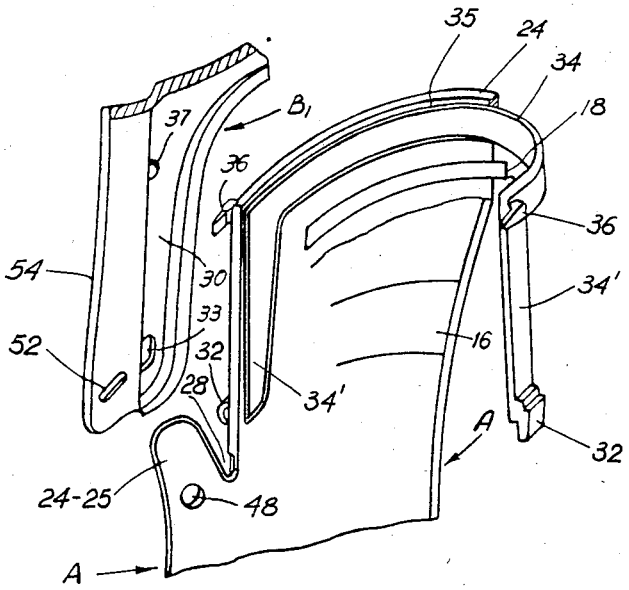
FIG. 6 is a perspective fragmentary view of the front part of the boot.
Figure 7:
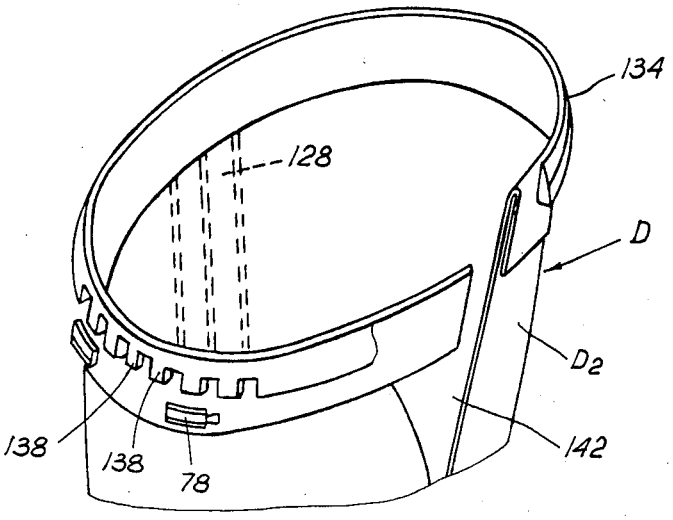
FIG. 7 is a partial perspective top view of the internal legging of the boot.

Front semi-legging $B_1$ terminates on its bottom part, with two longitudinal appendices 30, provided with polygonal apertures to engage hooked prongs 32 in the lower ends of the arms of a bracket 34 (FIG. 6) the mid part of which is arched to house in a groove 35 in the proximity of the internal peripheral wall of front tabs 24, pairs 24–25. The top ends of bracket 34 are provided with hooked prongs 36, aligned with the other prongs 32.

When bracket 34 is engaged in housing 35 in the front of each tab of pair 24–25, the pairs of hooked prongs 32–36 project for a certain distance from the external face of said front tab 24 through the relative shaped apertures to engage forcibly in other apertures 33, 37 in the corresponding positions of longitudinal appendices 30 of front semi-legging $B_1$. In this way, said semi-legging $B_1$ will be secured firmly to front tab 24 of boot A.

Figure 5:
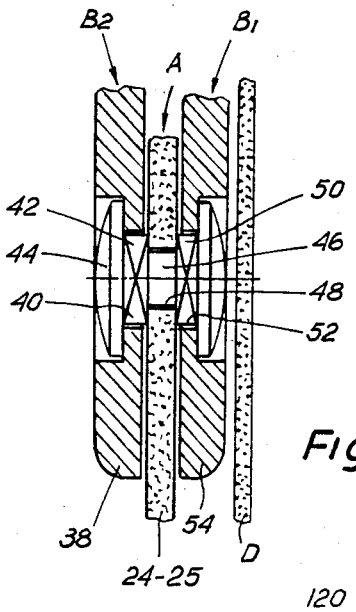
FIG. 5 is a secional detail taken on line V—V of FIGS. 1 and 4.
Figure 4:
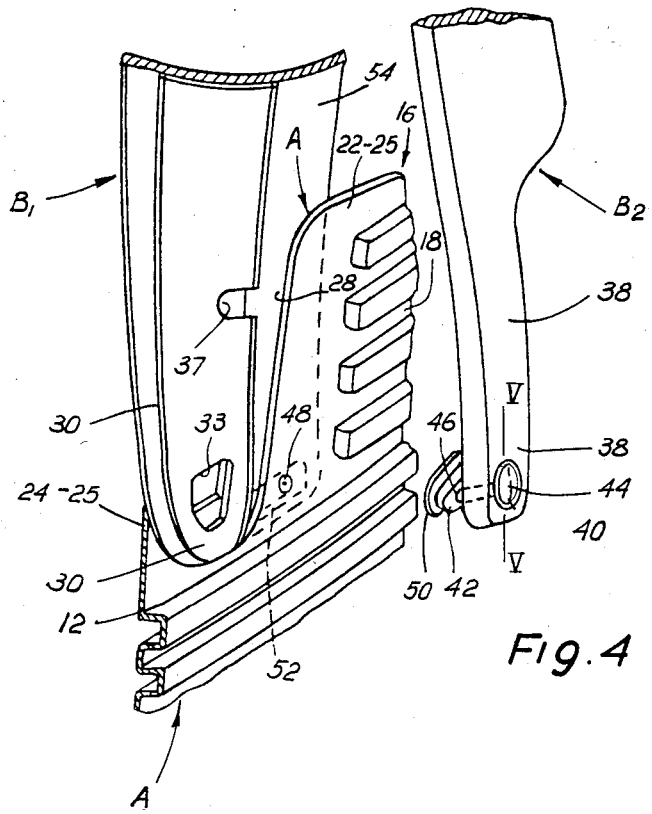
FIG. 4 is a perspective frangmentary view showing the connecting and articulated joint elements between the base structure and legging elements.

The structure of semi-legging $B_2$ is similar to that of semi-legging $B_1$ and its vertical ends terminate with two longitudinal appendices 38 (FIGS. 4 and 5) which are parallel and coplanar with appendices 30 of said semi-legging $B_1$. Each extremity of longitudinal appendices 38 is provided with a suitably shaped aperture 40 to house the corresponding shaped part 42 of a botton actuated pin 44 the mid part 46 of which is cylindrical in shape to engage movably a hole 48 in tab 25 of boot A. The push botton type pin 44 terminates at is other end with a shaped part 50 engaging an aperture 52 in the bottom of an offset tab 54 located parallely and laterally in aperture 30 of front semi-legging $B_1$ so that said tab 54 will be located inside boot A, and so that the corresponding tab of pair 24–25 will overlap on it.

Since the push bottom pins 44, rotatable in holes 48 of the pair of tabs 24–25 of boot A are co-axial, and located at the height of the malleolus of the user's foot, deambulation will be easy and without any resistance. More over, said pins 44 ensure on their bottom part a bond between semi-leggings $B_1$ and $B_2$ whilst the resilient structure of the pair of tabs 24–25 permits flexure of said legging $B_1$–$B_2$ on a plane orthogonal or substantially orthogonal to the plane on which lies the common axis of the two pins 44.

The coupling and reciprocal securing of boot A and semi-legging $B_1$ and $B_2$ are made possible, as already stated, by coupling and securing means $C_1$ and $C_2$ which are in fact substantially equal to each other. With specific reference to FIGS. 10 thru 13 each of said elements $C_1$ and $C_2$ consists of two complementary listels 66 and 68 made of flexible material.

A part of the extremities 70 of said listels are identical and each terminates with a quadrilaternal window 72 provided at one of its transversal ends with a rear projecting tooth 74 with respect to the top face of listel 66–68 just considered.

Figure 10:
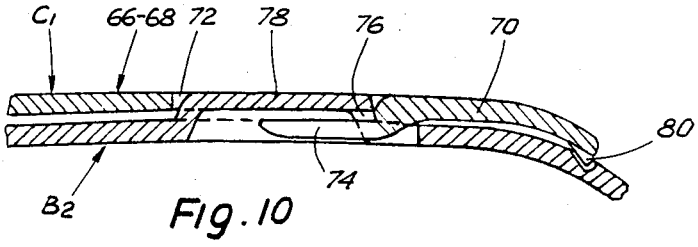
FIGS. 10 and 11 are sections of the locking elements taken on lines X—X and XI—XI of FIG. 1.
Figure 11:
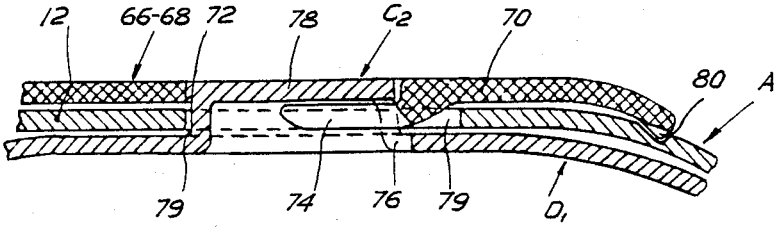

Tooth 74 engages with an aperture 76 in one of the peripheral transversal walls of a parallelopipedal projecing part 78 which fits in opening 72 and which is integral and projecting from the outer face of rear semi-legging $B_2$ in the case of locking means $C_1$ (FIG. 10) and from the outer face of inner element D (to be described infra) and this in the case of locking means $C_2$ (FIG. 11).

In this case the projecting part 78 is higher than the corresponding projecting part shown in FIG. 10 because said first projecting part fits in an aperture 79 provided laterally in vamp 12 of outer boot A, thereby to permit coupling between the latter and internal element D. The transversal edge of extremity 70 of complementary listels 66–68 is provided on its bottom with a tooth so, apt to engage with a cavity in the outer face of both semi-legging $B_2$ and vamp 12 of outer boot A in that said extremity 70 is curved and therefore apt to adhere resiliently to said respective face.

The ends of complementary listels 66–68 are provided with the parts of an adjustable latch.

The other end of listel 66 (FIGS. 12 and 13) is provided with a series of apertures 82 a part of the transversal walls of which is inclined to form a succession of saw teeth. The end of listel 68 is integral with a box shaped body 84 one of the transversal walls of which is provided with an aperture 85 in which end 82 of listel 66 is inserted. Bottom wall 86 of box shaped body 84 has at least one saw tooth shaped tooth 88 which engages with one of apertures 82 of listel 66; said saw teeth 88 are oriented in opposite direction with respect to their apertures 82, to provide a stable coupling between the two listels 66 and 68.

Bottom wall 86 is provided, in the neighborhood of its free end and after teeth 88, with a rectangular aperture 90, crossed in an opportune position by a cross bar 92 which in turn delimits an aperture 94 of limited width with respect to the first aperture. A slider 96 is fitted movably in apertures 92 and 94, said slider being held in its correct operating position by two pairs of shaped projecting parts 98 and 99 which are integral with the longitudinal walls of boxed shaped body 84. The pair of projecting parts 98 and 99 are located in opening 94 in the proximity of cross bar 92 and alternatively engages with its lateral ends the elements of a pair of projecting parts 100 on slider 96. Similarly, the pair of projecting parts 99 is fitted in opening 90 close to teeth 88 and with these engages a pair of inclined planes 102 in the longitudinal edges of slider 96.

The end of slider 96 adjacent to teeth 88 terminates with an resilient yieldable cross bar 104 which extends toward said teeth and into the aperture formed between the slider and listel 66 of pair 66–68.

With regard to the arrangement just considered, slider 96 may be subjected to two coordinated movements: the first along its longitudinal axis and the other in a direction perpendicular to the direction of said movement.

Said slider is positioned in two positions by the engagement of the pair of projecting parts 100 with one or the other of the slides of the pair of projecting parts 98 while listel 66 remains inserted in the aperture of cross bar 104 so that teeth 88 of box shaped body 86 engage in aperture 82. However, when slider 96 is in the position shown in FIG. 13 (where the pair of projecting parts 99 is on the left hand side of the pair of projecting parts 98, while the pair of projecting parts 99 engages inclined planes 102) the second movement of slider 96 is blocked by the engagement of the pair of projecting parts 99 with inclined planes 102 to lock also listel 66 to listel 68 through teeth 88 which are engaged in apertures 82.

Figure 12:
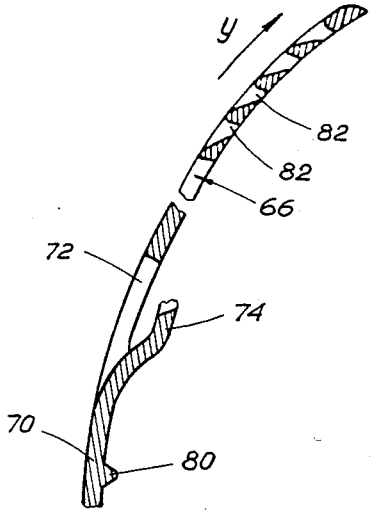
FIG. 12 is a partial section of one of the securing belts of the legging of the boot taken on line XII—XII of FIG. 1.
Figure 12:
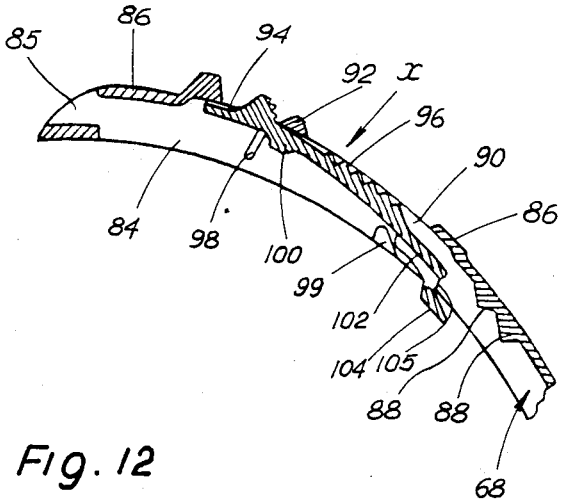

Conversely, when slider 96 is in the position shown in FIG. 12 where the pair of projecting parts 99 is on the right hand side of the pair of projecting parts 98 and inclined planes 102 are disengaged from the pair of projecting parts 99, the slider can be shifted in a direction perpendicular to its longitudinal axis by exerting pressure on same in the direction indicated by arrow X.

In this case the end of said slider along with cross bar 104 oscillate in a clockwise direction to disengage apertures 82 of listel 66 from teeth 88 of box shaped body 86 thereby freeing the elements of pair 66–68.

It should be noted also that when slider 96 is in the locked position (FIG. 13), it is possible to closely position and to slide listel 66 with respect to listel 68, in the direction of arrow Y due to the orientation of the inclined planes of teeth 88 and of apertures 82 in relation to the resilience of cross bar 104. It is thus possible to easily and quickly secure to each other semi-legging $B_1$ and $B_2$ and secure boot A to internal element D with the required tightness. In this case teeth 74 of the pair of listels 66–68 pertaining to locking element $C_2$ engage in the parallelopiedal projecting parts 78 which are integral with said element D (FIG. 11).

Figure 2:
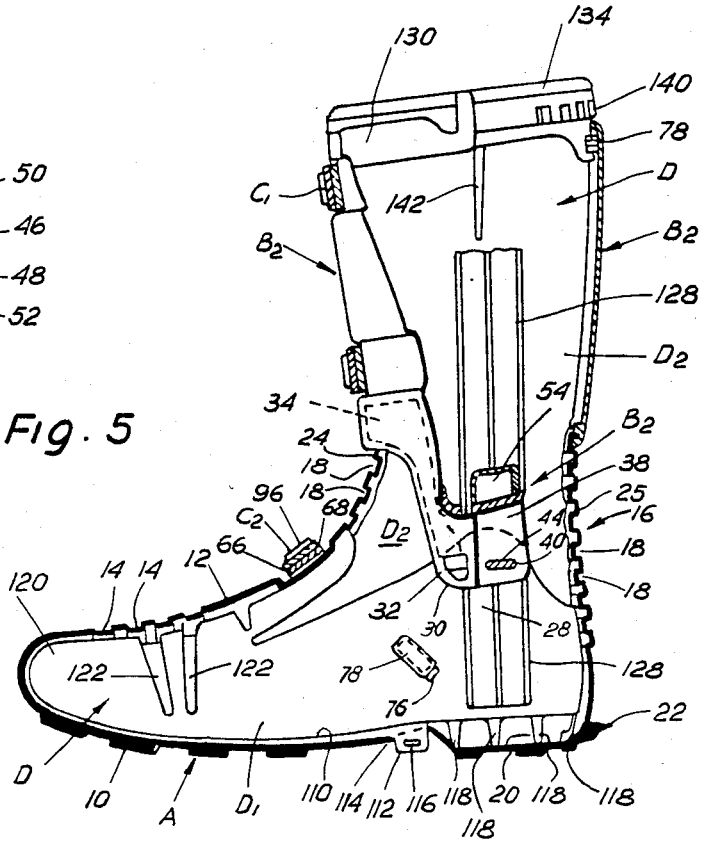
FIG. 2 is a vertical section with the internal parts of the boot in view.
Figure 3:
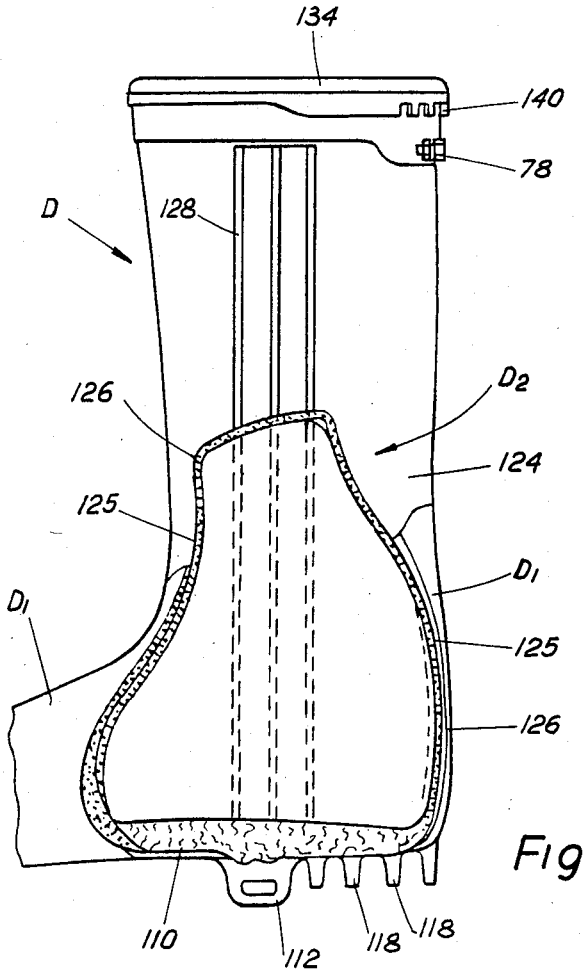
FIG. 3 is a partial side elevation view of the internal boot.
Figure 15:
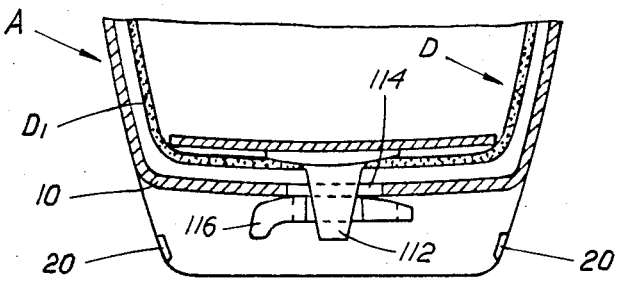
FIG. 15 is a transversal section of the boot at the height of the cavity and of the movable connection between the base structure and the inner boot.

Having reference in particular to FIGS. 2 and 3, internal element D, similarly to the outer structure, is provided with a boot $D_1$ of flexible material, which is housed, allowing a suitable play within outer boot A. A perforated tab 112 is integrally connected, in a convenient position to sole 110 of boot $D_1$ (FIG. 15); said tab crosses an aperture 114 in sole 10 of boot A and extends into the interior in a position that will not interfere with deambulation. An elastic key 116 engages in the aperture of tab 112; said key cooperates with sole 10 and secures outer boot A and inner boot D, to each other.

Heel 118 of boot $D_1$ consists of a plurality of prism shaped projecting parts to form in conjuction with outer boot A a ventilating chamber communicating with the exterior through holes 20 in the heels of said boot A.

Vamp 120 of boot $D_1$ is provided with transversal apertures 122 which coincide substantially with grooves 14 of vamp 12 of boot A and in alignment with listels 66–68 of element $C_2$, parallelopipedal blocks 78 to anchor the ends of said listels.

Internal boot $D_1$ houses a sock $D_2$, the lower part of which adheres to the internal walls of said boot, while the top part extends beyond the edge of outer legging $B_1$–$B_2$. Said sock $D_2$ consists, in the known manner, of an outer flexible film 124 which supports a padding 125 made for example, of polyurethane foam, provided with internal lining 126.

Figure 8:
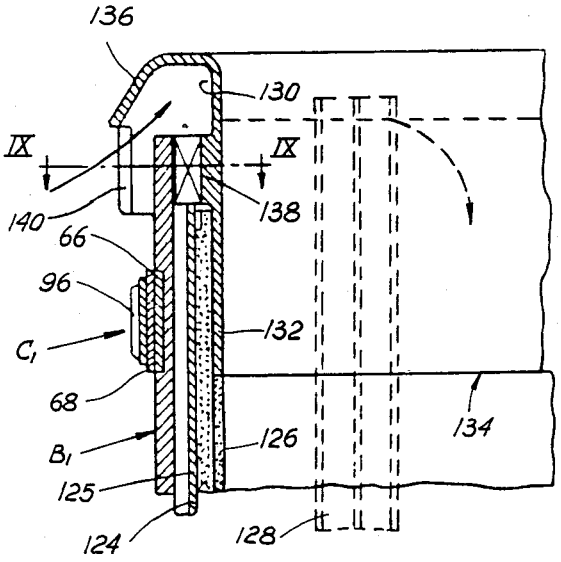
FIG. 8 is a partial top vertical section of the legging.
Figure 9:
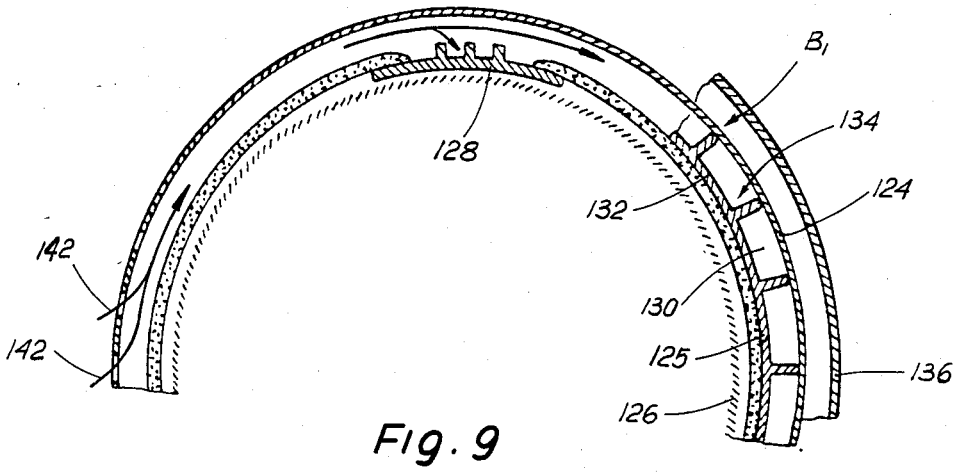
FIG. 9 is a section taken on lines IX—IX of FIG. 8.

The legging of sock $D_2$ is provided on its sides, in opposite positions, with two flexible grooved hollow strips 128 extending vertically to place in communication the air space interspace between the outer and inner element of the boot, with the ambient, in the manner described infra. Precisely, the grooves in strips 128 are prevalently connected at the ends of said strips, on the one side with heel chamber 118 and on the other side with annular chamber 130 (FIGS. 8 and 9) in the top part of legging $B_1$–$B_2$. The internal strip 132 of a flexible collar 134 is suitably secured to edge of sock $D_2$ the other end 136 of the collar being folded outwardly to form annular chamber 130. Strip 132 of collar 134 is provided externally along at least part of its periphery with a plurality of spacer blocks 138, part of which engage with the internal band of leg piece $B_1$–$B_2$ to form between the latter and the legging of sock $D_2$ the interspace for ventilation, while the remaining part of said blocks form apertures on the bottom of chamber 130 which outlet inside sock $D_2$ to thus complete the ventilation of the boot. For this purpose the folded edge 136 of flexible collar 134 is provided with apertures 140 in a suitable position.

Collar 134 has an interruption extending along its generatrix, which connects with slot 142 in the top part of the legging of sock $D_2$ and which is provided with a locking device, consisting for example, hook and loop or pile type fastener to facilitate insertion and removal of the boot.

FIG. 12 shows a horizontal section of one of the coupling elements for the parts constituting the legging comprising two elements: the front element $B_1$ and the rear element $B_2$ which are joined to each other—besides the coupling devices provided on said elements $B_1$ and $B_2$—also by locking devices $C_1$ and $C_2$ as illustrated in FIGS. 1, 12, 13 and 14.

Each end 70 is the same for listel 66 and listel 68 and terminates with a quadrilateral window 72 having, at its transverse edge, a tooth 74 (s.FIG. 12) protruding both from said opening and from the lower face of both element 66 and element 68.

Each tooth 74 at the end of the complementary elements 66, 68 engages a ledge 78 in the walls of a quadrilateral bulge foreseen on the rear semi-legging $B_2$. In the case of the locking device $C_2$, this ledge 78 is on the shoe A (s.FIGS. 10 and 11). In this latter case, the ledge 78 is higher than the corresponding ledge in FIG. 10, as it is housed in an aperture 79 on the side of vamp 12 of the external shoe A to allow the coupling between the latter and the internal element D.

The transversal edge of end 70 of the complementary elements 66, 68 has tooth 80 on the lower part which engages the corresponding recess provided on the external face both of the semi-legging $B_2$ as on the vamp 12 of the external shoe A, said end 70 being curved and resiliently adhering to the semi-legging $B_2$ or to the shoe A.

The contiguous ends of each listel 66,68 terminate with an adjustable closing device. In the case illustrated in FIGS. 12 and 13, the free end of listel 66 has a plurality of openings 82 in which are engaged the saw-shaped teeth 88 on the complementary element 68. These teeth are on the lower wall of the C-shaped body having a transversal opening 85 at one of its ends into which slides the end of the complementary element 66 provided with apertures 82. The teeth 88 are slanted in a direction opposite to that of the teeth delimiting opening 82 thereby obtaining a stable one-directional connection.

The upper wall with aperture 85 of the C-shaped body 84 is provided between its free end and teeth 88 (FIG. 12) with a double aperture 90–94 separated by a ledge 92 to house slidably a slider 96. This slider 96 may be moved in two directions, namely longitudinally, along aperture 90 and perpendicularly in opposition to the resilient action, i.e. from top to bottom with respect to FIG. 12, in order to disengage element 66 from teeth 88, more precisely the teeth of aperture 82 of said element 66.

In this way it is possible, by exerting pressure in the direction of arrow X on slider 96, to disengage element 66 from teeth 88 which generally are retained by the resilient action of said slider 96, said slider being maintained under thrust through its end 102 against wall 86 of the C-shaped body 84. This is because when the end of element 66 engages aperture 85 of body 84, it also enters into aperture 105 provided on one of the ends of slider 96 to engage teeth 88, thus maintaining teeth 88 engaged in apertures 82.

Slider 96 is held in the locking position by moving it to the left with respect to FIG. 12, thereby engaging the ends of the projecting parts 99 on the side walls of the C-shaped body 84 with the projections 102 on the longitudinal walls of slider 96.

Instead, when slider 96 is moved in such a position as to disengage projections 99 and 102, it is possible to free element 68 by pressing slider 96 in the direction of arrow X.

From what described in the following description the scope and intent of the invention are confirmed, i.e. the boot can be removed and worn, and in this latter position it permits the user to move freely without any resistance. Moreover, internal ventilation of the boot is ensured and takes place automatically during deambulation, as the foot of the wearer, by shifting within the outer boot A exerts a pumping action for the air which is caused to circulate from the interior to the exterior of said boot through grooved strips 128, annular chamber 130 and apertures 140. In case the boot is worn by a motorcyclist, the internal ventilation of said boot is increased, as the wind, by striking apertures 140 (which are conveniently arranged on collar 134) causes drawing out of the stagnating air inside the boot; thereby ensuring proper ventilation.

It is understood that locking elements $C_1$ of semi-leggings $B_1$ and $B_2$ may be applied differently from the use considered, with reference, in particular to locking element 96–100. Moreover, securing means 74–76 of the listels 66–68 in semi-leggings $B_1$–$B_2$ may be suitably modified; for example said element may consist of a single listel, at the ends of which are fitted with the coupling means 82–84.

It is understood that modifications and variants may be introduced in the boot described and illustrated, in relation to application and other end use requirements, without departing from the scope, spirit and domain of the invention.

I claim:

1. A boot, particularly for use by a motorcyclist or other wearer, comprising in combination, an inner part to be worn by the wearer, an outer part formed of three complementary portions including a first portion forming a shoe of said boot and being located at the bottom of said boot, and two semi-leggings which are complementary to each other and which join at an upper part of said shoe; said two semi-leggings having perforated appendices at their respective bottom portions, said shoe including a vamp, said vamp being provided with a legging, articulated elements which are held, at the height of the malleolus of the wearer's foot, by said legging and which are hinged to said perforated appendices; and securing devices for movably securing said two semi-leggings to each other.

2. Boot according to claim 1 wherein said two semi-leggings includes a front semi-legging B1, and the lower parts of said two semi-leggings $B_1$, $B_2$ terminate with pairs of longitudinal appendices (30,38), the edges of said appendencis being sufficiently close to each other to close one leggings and the pair of said pairs of appendices 30 associated with the front semi-leggings $B_1$; the boot is provided with longitudinal tabs 54 and with articulated pins 44 which engage said tabs and which also engage both the other pair of appendices (38) and articulated elements (24–25) of said vamp 12.

3. Boot according to claim 1, wherein said vamp 12 is provided, laterally, at the height of the malleolus of the foot with opposite slots 28 to permit the insertion of longitudinal tabs 54 of the pair of front appendices 30 which are parallely offset so that the side walls (24–25) of vamp 12 will be situated between appendices 38 of the rear semi-legging $B_1$ and said longitudinal tabs 54 and said pairs of appendices and tabs are secured by articulations to the relevant side walls (24–25) of the vamp by articulated pins (44).

4. Boot according to claim 1 wherein vamp 12 of outer boot (A), fabricated at least in part of resilient material, is provided, at the height of the wearer's malleolus, with opposite bellows zones (18) intended to facilitate deambulation whilst in the area below the front bellows zone, vamp 12 is provided with adjustable securing means ($C_2$) anchored in the neighborhood of the heel of said boot.

5. Boot according to claim 1, further including an arched bracket (34) integral with a top front part of said vamp (12), said bracket being secured firmly to the lower end of the front semi-legging ($B_1$), via its arms which extend parallel to the longitudinal appendices (30) of said semi-legging.

6. Boot according to claim 5, wherein said arched bracket (34) is provided, at the ends of its arms, with pairs of hooks (32,36), the elements of one pair being folded in orthogzonal opposite positions with respect to the elements of the other pair (36) to secure the front semi-legging ($B_1$) movably to the top front wall of said vamp (12).

7. Boot according to claim 1, wherein said legging (16) is provided with front and rear bellows zones (18) which extend close to the lower edges of said semi-leggings.

8. Boot according to claim 1, wherein each one of the movable securing elements has at least one listel (68) provided at its ends with coupling means (82–84) cooperating with said legging.

9. Boot according to claim 8, wherein a box shaped body including transverse walls and a bottom wall (84), integral with one of the ends of said listel (68) and one of the transversal walls of which is provided with an aperture (85) in which one end (82) of the other listel (66) is inserted, while said bottom wall (86) houses a spring slider (96) cooperating with said other end which engages its openings (82) with at least one tooth (88) integral with said bottom wall (86) and which said spring slider (96) is provided, at one of its ends, with means (98–100) to hinge said spring slider to said transversal walls of said box shaped body and on its other end with resilient means (104) which engage said openings (82) on the end of said listel (66) with said tooth (88) of the box shaped body.

10. Boot according to claim 8, wherein said spring slider (96) is provided at one of its ends hinged to said box shaped body (86), with a pair of projecting parts 100, which hold said slider in two predetermined positions, while the other end of said slider (96) is provided, lengthwise, with a pair of inclined planes (102) which may engage with a further pair of projecting parts (99), integral with an the internal wall of said box shaped body (86), to lock to the latter, integral with slider 96, the end of said listel (66) being provided with apertures (82).

11. Boot according to claim 8, wherein said listel (68), provided with coupling means (82–84), consists of two complementary listels (66–68), the free ends (70) of which are provided with teeth (74) apt to engage relative apertures (76) in one of semi leggings $B_1$–$B_2$.

12. Boot according to claim 1, wherein a flexible collar (134) in the top part of a sock ($D_2$) of said inner part (D), which is housed within said boot, and the top edge (136) of which forms, at the summit of the boot, an annular chamber (130) communicating both with the interior of said sock and with the interior of the bottom of the boot by means of vertical grooves (128) provided between the interior of boot ($B_1$–$B_2$) and the interior of said sock to ventilate the interior of said boot.

13. Boot according to claim 12, wherein annular chamber (130) of flexible collar (134) is provided, in its lower part, with a series of apertures formed by spacer blocks (138) part of which communicate with the interior of said sock ($D_2$), and part with an interspace formed between the interior of said legging ($B_1$–$B_2$) and said sock, said annular chamber (130) being provided, toward its rear part, with apertures communicating with the ambient for ventilation of the boot.

14. Boot according to claim 12 wherein at least one flexible strip (128) provided with longitudinal grooves and secured to the exterior of said sock ($D_2$) to form channels for air circulation in the interspace between said sock and the legging.

15. Boot according to claim 12, wherein internal element (D) is provided, below said sock ($D_2$), with a flexible boot ($D_1$), secured movably by disassemblable elements (112,116), to sole (10) of the boot.

* * * * *